US006454637B1

(12) United States Patent
Gotkis

(10) Patent No.: US 6,454,637 B1
(45) Date of Patent: Sep. 24, 2002

(54) EDGE INSTABILITY SUPPRESSING DEVICE AND SYSTEM

(75) Inventor: Yehiel Gotkis, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 12 days.

(21) Appl. No.: 09/670,469

(22) Filed: Sep. 26, 2000

(51) Int. Cl.[7] ..... B24B 5/00
(52) U.S. Cl. ..... 451/287; 451/60; 451/398
(58) Field of Search ..... 451/285, 286, 451/287, 288, 289, 397, 398, 60, 36

(56) References Cited

U.S. PATENT DOCUMENTS

| | | | | | |
|---|---|---|---|---|---|
| 5,584,751 | A | * | 12/1996 | Kobayashi et al. | 451/288 |
| 5,597,346 | A | * | 1/1997 | Hempel, Jr. | 451/289 |
| 5,931,725 | A | * | 8/1999 | Inaba et al. | 451/288 |
| 6,019,868 | A | * | 2/2000 | Kimura et al. | 451/287 |
| 6,030,487 | A | | 2/2000 | Fisher, Jr. et al. | 156/345 |
| 6,066,030 | A | * | 5/2000 | Uzoh | 451/287 |
| 6,080,040 | A | * | 6/2000 | Appel et al. | 451/288 |
| 6,089,961 | A | * | 7/2000 | Cesna et al. | 451/287 |
| 6,116,993 | A | * | 9/2000 | Tanaka | 451/287 |
| 6,146,256 | A | * | 11/2000 | Joo | 451/287 |
| 6,200,207 | B1 | * | 3/2001 | Hsu | 451/287 |
| 6,234,884 | B1 | * | 5/2001 | Inaba | 451/288 |
| 6,277,008 | B1 | * | 8/2001 | Masuta et al. | 451/288 |
| 6,290,584 | B1 | * | 9/2001 | Kim et al. | 451/288 |

FOREIGN PATENT DOCUMENTS

| | | | |
|---|---|---|---|
| EP | 0 870 576 A2 | 10/1998 | B24B/37/04 |
| EP | 0 870 576 A3 | 10/2000 | B24B/37/04 |
| WO | WO 01/12385 A1 | 2/2001 | B24B/37/04 |

* cited by examiner

*Primary Examiner*—Eileen P. Morgan
*Assistant Examiner*—Hadi Shakeri
(74) *Attorney, Agent, or Firm*—Martine & Penilla, LLP

(57) ABSTRACT

The present invention provides device and system for suppressing edge instability during a chemical mechanical planarization (CMP) process for planarizing a surface topography on a wafer. A wafer carrier holds and rotates a wafer on a polishing surface of a polishing pad that is arranged to move in a first direction. The edge instability suppressing device includes a front process unit and a second process unit. The front process unit is disposed around a first portion of the wafer facing the first direction and arranged to align to the polishing surface of the polishing pad independent of the wafer during CMP processing. The back process unit is disposed around a second portion of the wafer opposite the first portion and is arranged to align to the polishing surface of the polishing pad independent of the wafer during the CMP processing. In so doing, the aligned front and back process units substantially reduce edge effects on the wafer during the CMP processing.

28 Claims, 9 Drawing Sheets

EDGE INSTABILITY SUPPRESSING DEVICE AND SYSTEM

CROSS REFERENCE TO RELATED APPLICATION

This application is related to U.S. patent application Ser. No. 09/608,510 filed on Jun. 30, 2000, and entitled "Wafer Carrier with Groove for Decoupling Retainer Ring from Wafer," by Yehiel Gotkis. This application is incorporated herein by reference.

BACKGROUND OF THE INVENTION

1. Field of the Invention

The present invention relates to chemical mechanical planarization (CMP), and more particularly to devices for reducing edge effects during wafer processing by CMP.

2. Description of the Related Art

Fabrication of semiconductor devices from semiconductor wafers generally requires, among others, chemical mechanical planarization (CMP), buffing, and cleaning of the wafers. Modern integrated circuit devices typically are formed in multi-level structures. At the substrate level, for example, transistor devices are formed. In subsequent levels, interconnect metallization lines are patterned and electrically connected to the transistor devices to define the desired functional device. As is well known, patterned conductive features are insulated from each other by dielectric material, such as silicon dioxide, for example. As more metallization levels and associated dielectric layers are formed, the need to planarize the dielectric material increases. Without planarization, fabrication of additional metallization layers becomes substantially more difficult due to the higher variations in the surface topography. In other applications, metallization line patterns are formed in the dielectric material, and then metal CMP operations are performed to remove excessive metallization.

FIG. 1 shows a schematic diagram of a chemical mechanical planarization (CMP) process 100 performed on a semiconductor wafer 102. In this process 100, the wafer 102 undergoes a CMP process in a CMP system 104. Then, the semiconductor wafer 102 is cleaned in a wafer cleaning system 106. The semiconductor wafer 102 then proceeds to a post-CMP processing 108, where the wafer 102 undergoes different subsequent fabrication operations, including deposition of additional layers, sputtering, photolithography, and associated etching.

The CMP system 104 typically includes system components for handling and planarizing the surface topography of the wafer 102. Such components can be, for example, an orbital or rotational polishing pad, or a linear belt-polishing pad. The pad itself is typically made of an elastic polymeric material. For planarizing the surface topography of the wafer 102, the pad is put in motion and a slurry material is applied and spread over the surface of the pad. Once the pad with the slurry is moving at a desired rate, the wafer 102, which is mounted on a wafer carrier, is lowered onto the surface of the pad for planarizing the topography of the wafer surface.

In rotational or orbital CMP systems, a polishing pad is located on a rotating planar surface, and the slurry is introduced onto or through the polishing pad. In orbital tools the velocity is introduced via pad orbital motion and wafer carrier rotation and the slurry is introduced from underneath the wafer through multiple holes in the polishing pad. Through these processes, a desired wafer surface is polished to provide a smooth flat surface. The wafer is then provided to the wafer cleaning system 106 to be cleaned.

One of the main goals of CMP systems is to ensure the uniform removal rate distribution across the wafer surface. As is well known, the removal rate is defined by Preston's equation: Removal Rate=KpPV, where the removal rate of material is a function of loading pressure P and relative velocity V. The term, Kp, is Preston coefficient, which is a constant determined by the composition of the slurry, the process temperature, and the pad surface.

Unfortunately, conventional CMP systems often suffer from edge effects that affect all three terms of the Preston equation, redistributing the removal rate and thus its uniformity across the wafer surface. The edge effects typically result from boundary conditions between a wafer edge and a polishing pad during CMP processing. FIG. 2A shows a cross-sectional view of a static model of conventional edge effect between a section of the wafer 102 and a polishing pad 104. In this static model, a uniform pressure is exerted on the wafer 102 in the form of a downforce as indicated by vectors 106. This down force 106, however, causes a deformation, which is indicated by vectors 112, of the pad 104 that is essentially transversal (i.e., normal) but with a substantial longitudinal-transversal perturbation zone near the edge 108 of the wafer 102. Thus, this deformation results in a lower pressure zone 110 near the edge 108. The edge 108 of the wafer 102 causes high pressure as indicated by vectors 111, thereby producing non-uniform high and low pressure areas near the edge 108.

According to Preston's Law, the creation of alternating pressure zones leads to non-uniform removal rate across the wafer. FIG. 2B illustrates a cross-sectional view of a dynamic model of the edge effect between a section of the wafer 102 and the polishing pad 104. A section of a retaining ring 116 retains the wafer 102 in place to retain the wafer 102 in a wafer carrier (not shown) that controls the movement of the wafer 102. In this configuration, the wafer 102 is in motion relative to the polishing pad 104 as indicated by vector $V_{rel}$. The pad 104 is generally elastic. As the wafer 102 moves with the relative velocity $V_{rel}$ over the pad 104, it thus causes elastic perturbation on the surface of the pad 104.

The translational motion of the wafer 102 and the elastic perturbation produce a longitudinal-transversal pad deformation wave on the surface 116 of the polishing pad 104 according to conventional wave generation theory. The deformation wave is typically a fast relaxing wave due to suppressive action of the extended wafer surface and the high viscosity of the pad material. This causes local redistribution of the loading and pressures near the edge 108 of the wafer 102. For example, low pressure zones 120, 122, and 124 are formed on the surface 114 of the pad 104 with progressively higher pressures relative to the distance from the edge 108 of the wafer 102.

Each of the low pressure zones 120, 122, and 124 is defined by local minimum and maximum pressure regions that cause uneven planarization of the surface topography. For example, the local minimum pressure region 126 of the low pressure zone 120 causes lower removal rates, resulting in local under-planarization of the surface topography. Conversely, the local maximum pressure region 128 of the low pressure zone 120 causes higher removal rates, resulting in local over-planarization of the surface topography. Thus, the overall planarization efficiency of the wafer 102 is substantially degraded.

Furthermore, in conventional CMP systems the frontal wave maximum produces sealing effect at the edge of a wafer that substantially reduces entry of slurry under the wafer. FIG. 2C shows a cross-sectional view of a sealing effect between a section of the wafer 102 and the polishing pad 104. The slurry is initially provided over the surface 114 of the polishing pad 104. As the wafer 102 moves with velocity Vrel relative to the polishing pad 104, the edge 108 of the wafer causes a high pressure as indicated by vector 152. This high pressure causes loading concentration of the slurry 150 at the edge 108 of the wafer 102, thereby restricting slurry transport underneath the wafer 102. In addition, high loading at the edge 102 may squeeze out the slurry out of pores and grooves of the polishing pad 104, creating slurry starvation conditions. As a result, internal sections of the wafer surface may not be provided with adequate amount of slurry for effective CMP processing.

Additionally, low pressure zones stimulate redeposition processes that can cause increased surface defectivity. Specifically, conventional CMP systems utilize dissolution and surface modification reactions, which are typically reducing volume type reactions stimulated by high pressure. In these reactions, pressure drops reverse the reaction, causing redeposition of dissolved by-products back to the wafer surface. Re-deposited material typically has uncontrollable composition and glues other particles to the wafer surface. This makes cleaning of the wafer substantially more difficult.

In view of the foregoing, what is needed is a device and system that can minimize edge effects on a wafer during CMP processing while reducing slurry sealing effect.

SUMMARY OF THE INVENTION

Broadly speaking, the present invention fills these needs by providing a device and system for suppressing edge instability during CMP processing. It should be appreciated that the present invention can be implemented in numerous ways, including as a process, an apparatus, a system, a device or a method. Several inventive embodiments of the present invention are described below.

In one embodiment, the present invention provides an edge instability suppressing device for use in planarizing a surface topography on a wafer in a chemical mechanical planarization (CMP) system. The CMP system includes a wafer carrier for holding and rotating a wafer on a polishing surface of a polishing pad that is arranged to move in a first direction. The edge instability suppressing device includes a front process unit and a second process unit. The front process unit is disposed around a first portion of the wafer facing the first direction and arranged to align to the polishing surface of the polishing pad independent of the wafer during CMP processing. The back process unit is disposed around a second portion of the wafer opposite the first portion and is arranged to align to the polishing surface of the polishing pad independent of the wafer during the CMP processing. In so doing, the aligned front and back process units substantially reduce edge effects on the wafer during the CMP processing.

In another embodiment, a CMP system for planarizing a surface topography on a wafer is disclosed. The CMP system includes a polishing pad, a wafer carrier, a first process unit, and a second process unit. The polishing pad has a polishing surface for planarizing the surface topography of a wafer and is arranged to move in a specified direction. The wafer carrier is arranged to hold and rotate the wafer on the polishing surface of the polishing pad. The first process unit is disposed around a first portion of the wafer facing the first direction and is arranged to align to the polishing surface of the polishing pad independent of the wafer during CMP processing. The second process unit is disposed around a second portion of the wafer opposite the first portion and is arranged to align to the polishing surface of the polishing pad independent of the wafer during the CMP processing. The aligned first and second process units substantially reduce edge effects on the wafer during the CMP processing.

In yet another embodiment, the present invention provides a CMP system for planarizing a surface topography on a wafer. The CMP system includes a polishing pad, a wafer carrier, and a first process unit. The polishing pad has a polishing surface for planarizing the surface topography of a wafer and is arranged to move in a specified direction. The wafer carrier is configured to hold and rotate the wafer on the polishing surface of the polishing pad. The first process unit is disposed around a first portion of the wafer facing the first direction and is arranged to align to the polishing surface of the polishing pad independent of the wafer during CMP processing.

Advantageously, the front and back process units effectively mask the edge of the wafer to minimize detrimental edge effects on the wafer during CMP processing and improve uniform removal rate. Preferably, the outer edge of the retaining is shaped in a rounded fashion to reduce the pressure so that the formation low pressure zones is minimized. This also minimizes the undesirable slurry sealing effect and further enhances uniform removal rate, thereby enhancing the uniform planarization of the wafer. Other aspects and advantages of the present invention will become apparent from the following detailed description, taken in conjunction with the accompanying drawings, illustrating by way of example the principles of the present invention.

BRIEF DESCRIPTION OF THE DRAWINGS

The present invention will be readily understood by the following detailed description in conjunction with the accompanying drawings. To facilitate this description, like reference numerals designate like structural elements.

DETAILED DESCRIPTION OF THE PREFERRED EMBODIMENTS

The present invention provides a device and system for suppressing edge instability during CMP processing. In the following description, numerous specific details are set forth in order to provide a thorough understanding of the present invention. It will be understood, however, to one skilled in the art, that the present invention may be practiced without some or all of these specific details. In other instances, well known process operations have not been described in detail in order not to unnecessarily obscure the present invention.

Figure 1:
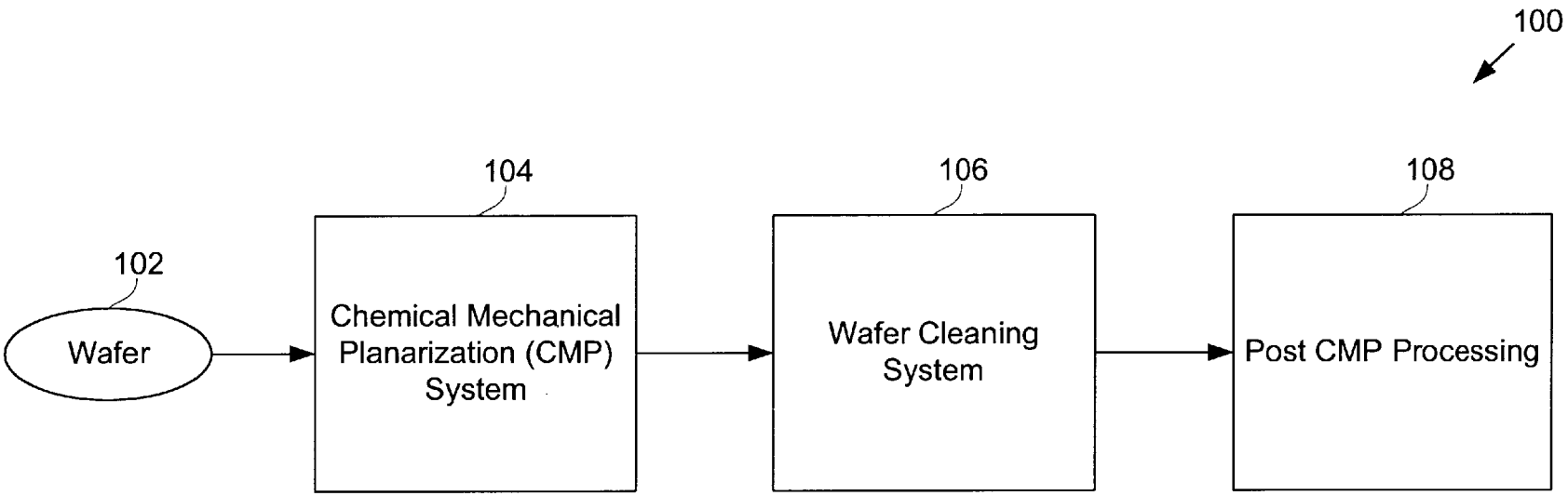
FIG. 1 (prior art)
FIG. 1 shows a schematic diagram of a chemical mechanical planarization (CMP) process performed on a semiconductor wafer.
Figure 2A:
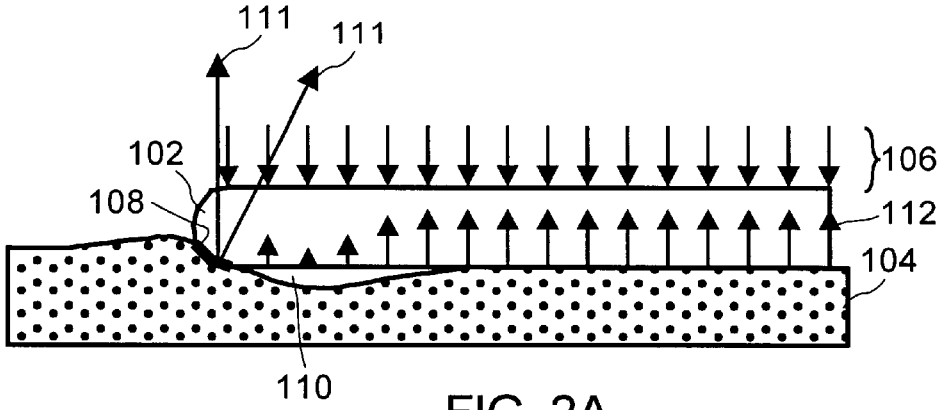
FIG. 2A (prior art)
FIG. 2A shows a cross-sectional view of a static model of conventional edge effect between a section of the wafer and a polishing pad.
Figure 2B:
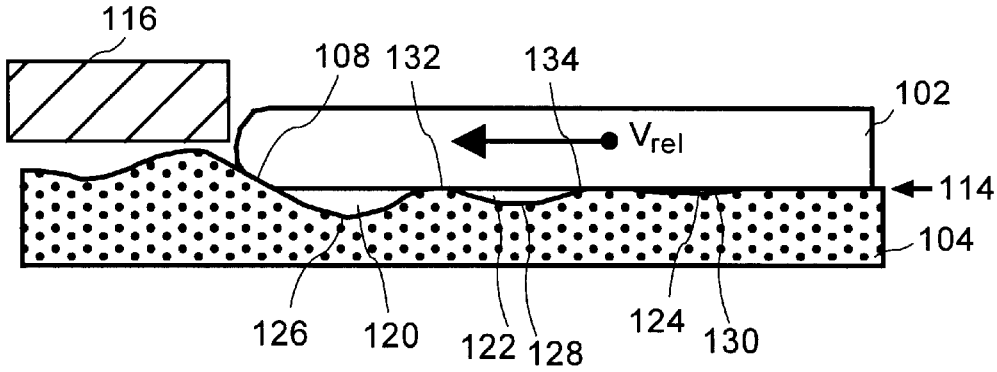
FIG. 2B (prior art)
FIG. 2B illustrates a cross-sectional view of a dynamic model of the edge effect between a section of the wafer and the polishing pad.
Figure 2C:
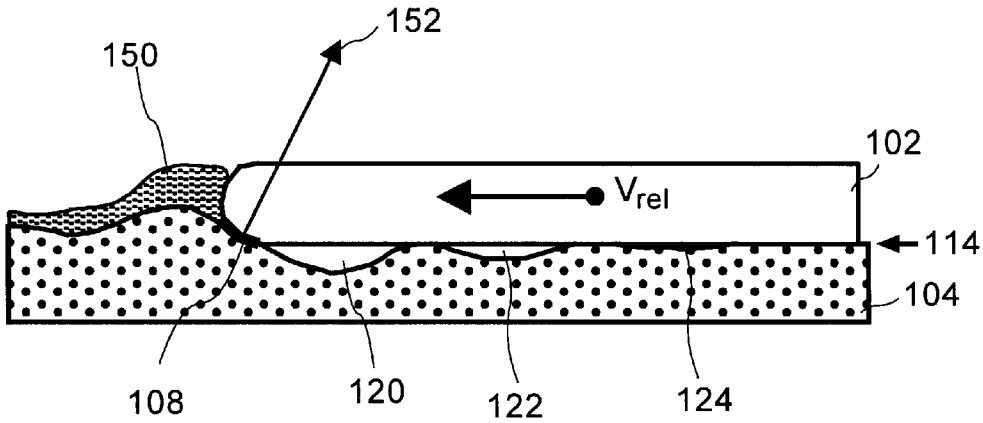
FIG. 2C (prior art)
FIG. 2C shows a cross-sectional view of a sealing effect between a section of the wafer and the polishing pad.
Figure 3A:
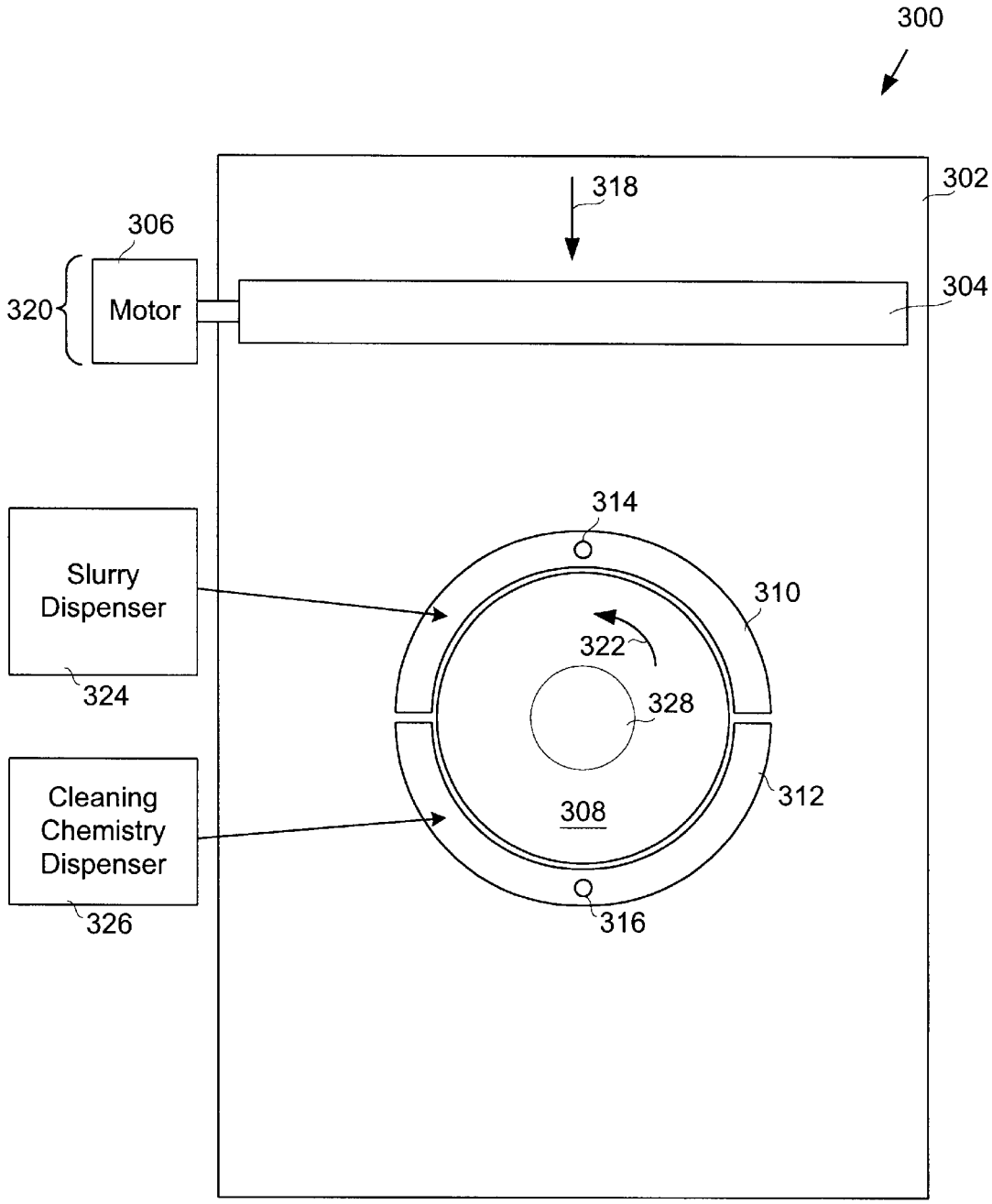
FIG. 3A shows an overview diagram of an exemplary CMP system in accordance with one embodiment of the present invention.

FIG. 3A shows an overview diagram of an exemplary CMP system 300 for planarizing the surface topography of a wafer in accordance with one embodiment of the present invention. The CMP system 300 includes a polishing pad 302, a conditioning unit 320, a wafer carrier 308, a front process unit 310, and a back process unit 316. The polishing pad moves in a linear direction indicated by arrow 318 for processing a wafer under the wafer carrier 308 with slurry from a slurry dispenser 324.

In the CMP system 300, the conditioning unit 320 functions to restore the surface activity and clean the surface of the polishing pad 302. Specifically, the conditioning unit 320 includes a pair of active rollers 304 disposed on either side of the polishing pad 302 and a motor unit 306 for rotating the rollers 304. When the polishing pad 302 is in operation, the rollers 304 revive the surface pores of the polishing pad 302 by cleaning the surface of undesirable materials.

The wafer carrier 308 is configured to hold and rotate a wafer underneath in a circular direction 322 during CMP processing and may include an elastomeric vacuum chuck and a vacuum port 328. The vacuum port 328 is provided on the wafer carrier 308 to apply vacuum pressure to the wafer to securely hold the wafer. During CMP processing, the wafer carrier 308 rotates, thereby rotating the wafer underneath. An exemplary wafer carrier is described in more detail in U.S. patent application Ser. No. 09/608,510 by Yehiel Gotkis, which was previously incorporated by reference.

The front process unit 310 and the back process unit 312 are disposed around the wafer carrier 308 and form separate units from the wafer carrier 308. The front process unit 310 is provided on the front side of the wafer carrier 308 facing the pad motion while the back process unit 312 is disposed on the back side of the wafer carrier 308. In this configuration, both the front and back process units 310 and 312 are passive devices in that they remain stationary and thus do not rotate with the wafer. The front and back process units 310 and 312 include control arms 314 and 316, respectively, which serve to independently control the position of and the pressure applied on the front and back process units 310 and 312. To substantially reduce undesirable edge effects on the wafer, the front and back process units 310 and 312 are preferably arranged such that their bottom surfaces remain substantially flush or even with the bottom surface of the wafer for CMP processing by controlling the pressure applied on the control arms 314 and 316.

In one embodiment, the front and back process units 310 and 312 are adapted to retain the wafer in place during CMP processing. In an alternative embodiment, the front and back process units 310 and 312 do not provide a wafer retaining function. Instead, a narrow active retaining ring may be provided on the wafer carrier 308 to properly hold, if necessary, the wafer during CMP processing.

The front and back process units 310 and 312 may be arranged to provide multi-functions for CMP processing. Preferably, the slurry dispenser 324 provides slurry to the front process unit 310 while a cleaning chemistry dispenser 326 supplies pad cleaning chemistry to the back process unit 312. However, the front and back process units 310 and 312 may each be configured to receive slurry and/or cleaning chemistry for providing slurry and cleaning chemistry during CMP processing.

Figure 3B:
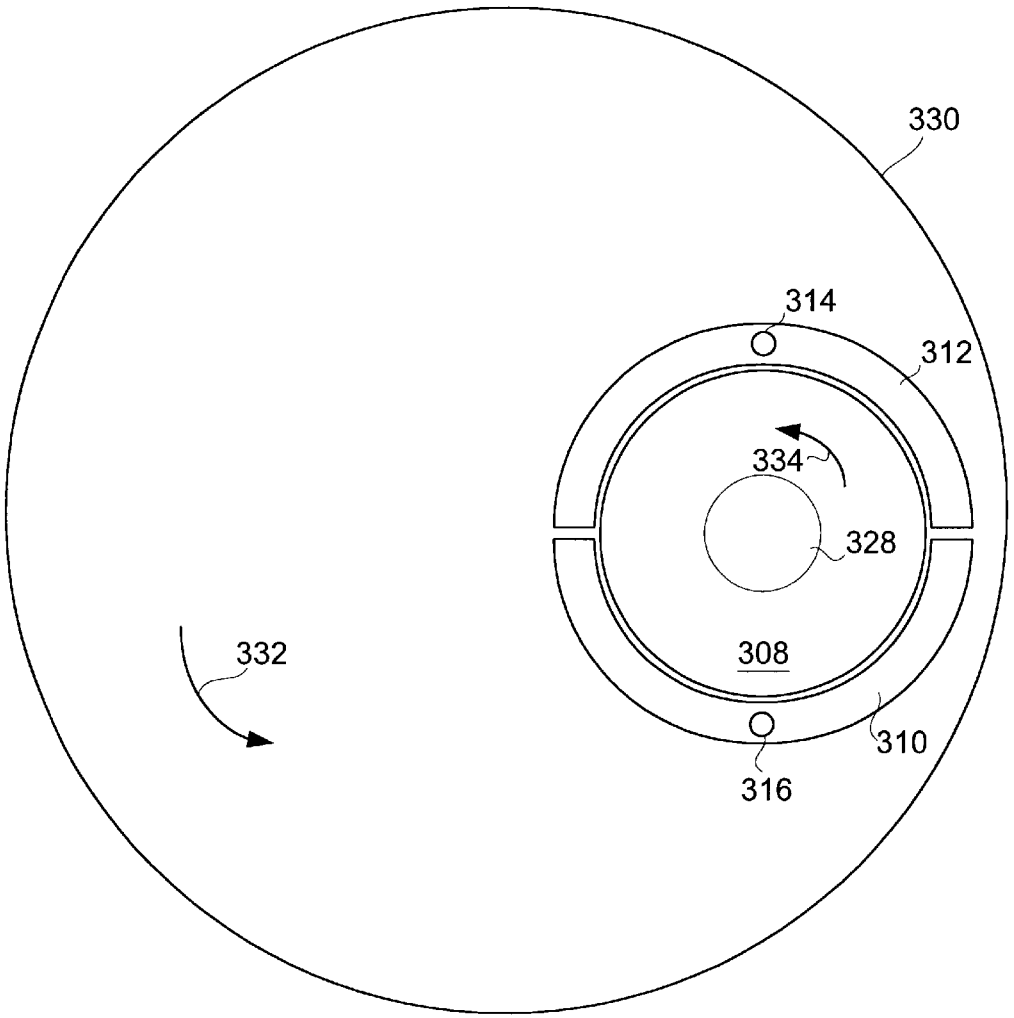
FIG. 3B shows an overview diagram of an exemplary CMP system with a rotating polishing pad in accordance with one embodiment of the present invention.

The front and back process units 310 and 312 may also be used in performing CMP processing of a wafer using a rotating polishing pad. For example, FIG. 3B shows a rotating polishing pad 330 that rotates in a direction indicated by arrow 332. The front and back process units 310 and 312 are provided on the rotating polishing pad 330 around wafer carrier 308. The front process unit 310 is disposed on the front side of the wafer carrier 308 facing the rotating pad motion while the back process unit 312 is provided on the other side of the wafer carrier 308. As in the linear polishing pad 302 of FIG. 3A, the front and back process units 310 and 312 are arranged such that their bottom surfaces remain substantially flush or even with the bottom surface of the wafer for CMP processing by controlling the pressure applied on the control arms 314 and 316. In addition, the front and back process units 310 and 312 may be supplied with slurry and/or pad cleaning chemistry during CMP processing of the wafer under the wafer carrier 308.

Figure 3C:
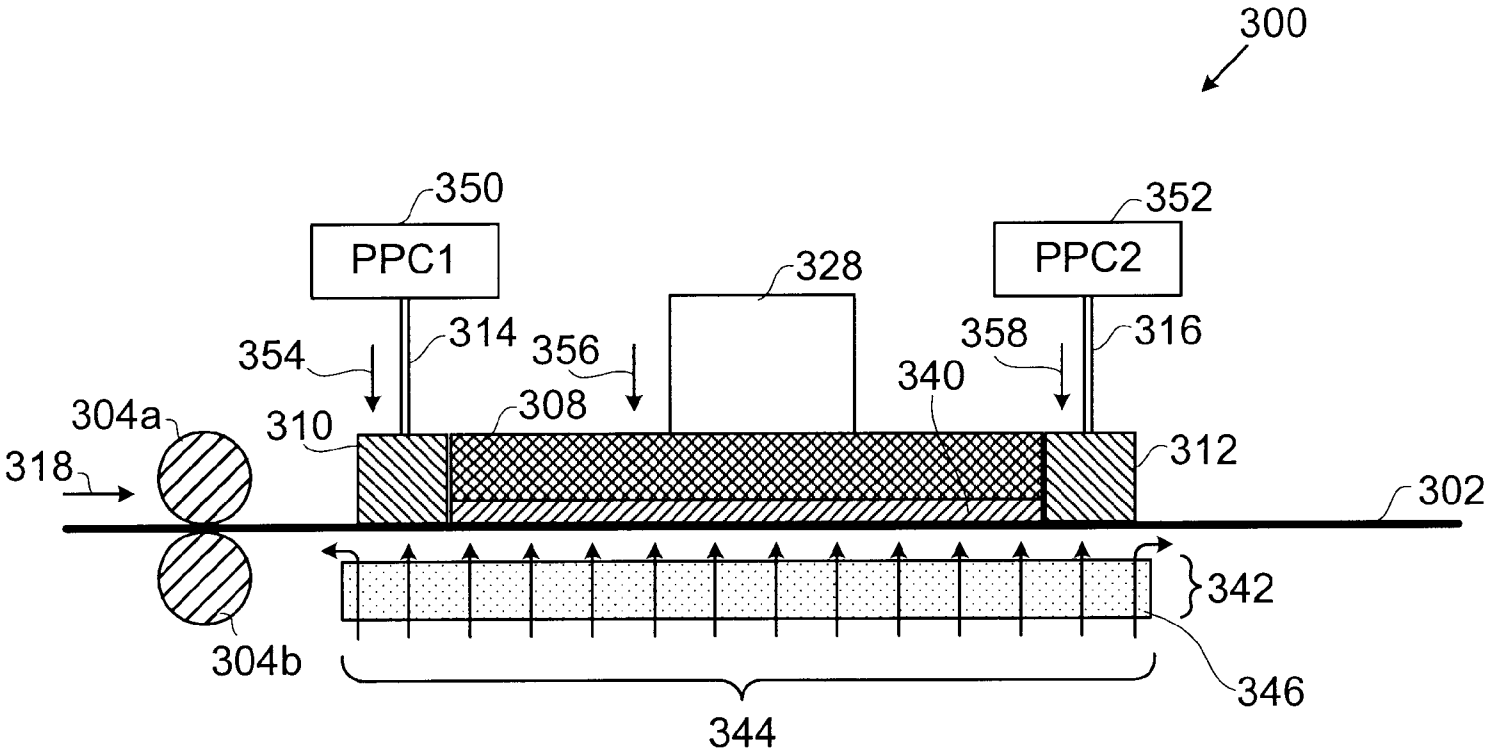
FIG. 3C illustrates a cross-sectional view of the CMP system for performing a CMP process on a wafer in accordance with one embodiment of the present invention.

FIG. 3C illustrates a cross-sectional view of the CMP system 300 for planarizing a surface topography of a wafer 340 in accordance with one embodiment of the present invention. In the CMP system 300, a pair of cylindrical rollers 304A and 304B is provided on either side of the polishing pad 302. The upper roller 304A is preferably of hard, abrasive material while the lower roller 304B is made of elastomeric material. These rollers 304A and 304B operate to condition and revive the surface pores of the polishing pad 302 when the pad 302 moves in the direction 318.

The CMP system also includes an extended air bearing unit 342 under the polishing pad 302. The extended air bearing unit 342 includes a table 346 through which air flow 344 is directed up toward the polishing pad 302. During CMP processing, the wafer 340 and front and back process units 310 and 312 exert pressure on the polishing pad. In this process, the air flow 344 functions as differential air bearing that allows redistribution of pressure load on the polishing pad 302. By thus redistributing the loading, the air bearing unit 342 provides substantially even support of the polishing pad 302 during CMP processing of the wafer 340.

Above the air bearing unit 342, the wafer 340 is held under the carrier 308 by a vacuum force provided through vacuum port 328. The wafer carrier 308 rotates and applies a pressure on the wafer 340 against the polishing pad 302.

The front and back process units 312 are disposed around the wafer carrier 308 and the wafer 340 and are coupled to control arms 314 and 316, respectively. The arms 314 and 316, in turn, are coupled to pressure and position controllers PPC1 350 and PPC2 352, respectively. The pressure and position controllers PPC1 350 and PPC2 352 determine and apply desired positions and pressures to the front and back process units 310 and 312, respectively, via control arms 314 and 316, respectively. In this configuration, it should be noted that the front and back process units 310 and 312 are separate and decoupled from the wafer carrier 308. This allows the front and back process units 310 and 312 to align independently to the plane of the polishing surface on the polishing pad 302. This alignment capability of the front and back process units 310 and 312 effectively masks the edge of the wafer 314 during CMP processing, thereby substantially eliminating undesirable edge effects and suppressing unwanted waves on the polishing pad 302.

Figure 3D:
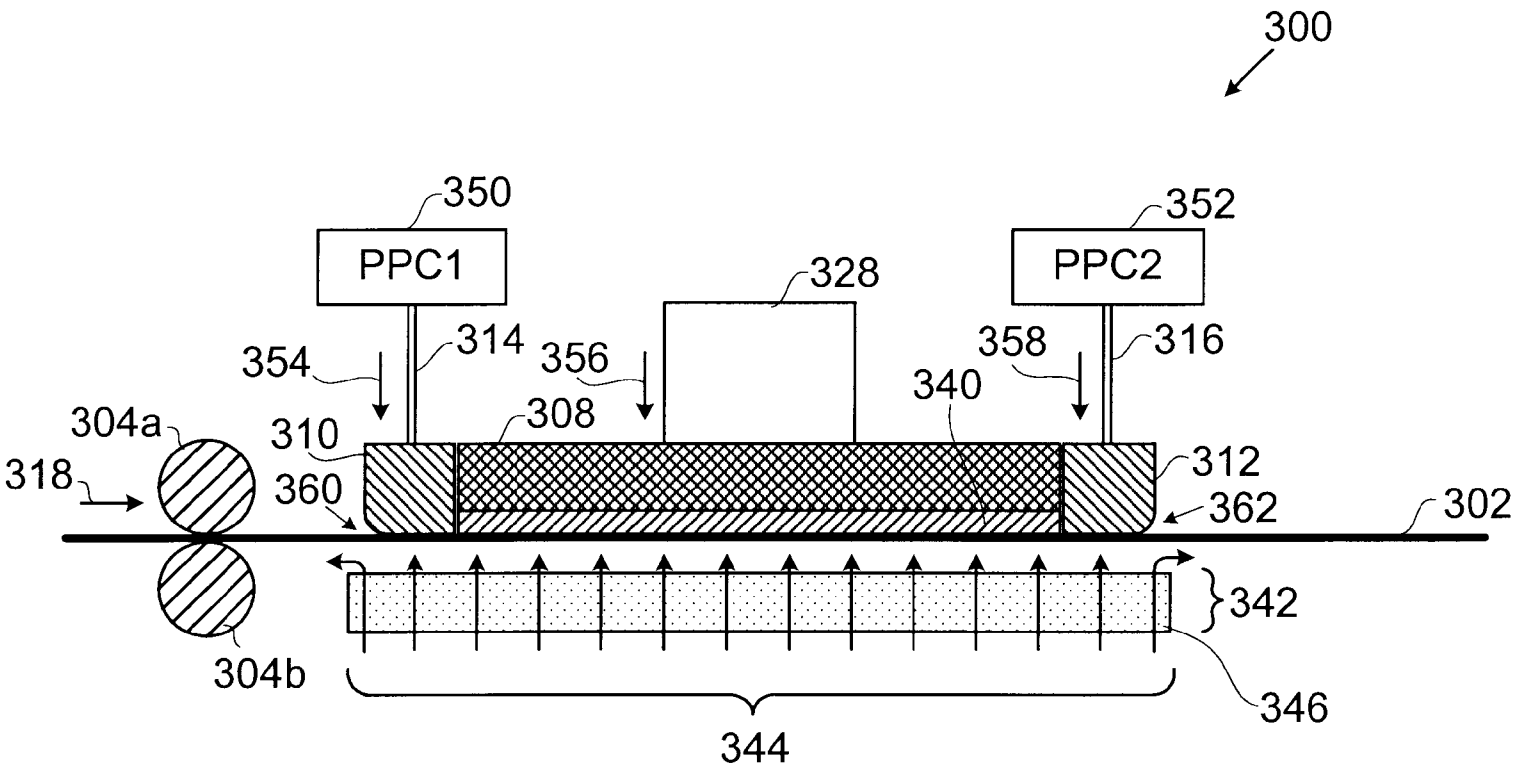
FIG. 3D shows a cross-sectional view of the CMP system with modified front and back process units in accordance with another embodiment of the present invention.

To further ensure elimination of residual edge effects, the front and back process units 310 and 312 may be configured to suppress edge effects that may arise from the edge of the front and back process units 310 and 312. FIG. 3D shows a cross-sectional view of the CMP system 300 with modified front and back process units 310 and 312 in accordance with another embodiment of the present invention. The CMP system 300 is similar to one illustrated in FIG. 3C with the exception of the front and back process units. Specifically, outer edges 360 and 362 of the front and back process units 310 and 312, respectively, are rounded to eliminate the abrupt edge of the front and back process units shown in FIG. 3C. The curvature of the rounded edges 360 and 362 of the front and back process units 310 and 312 functions to distribute pressure over a larger surface area and thus substantially reduces the edge effects and suppresses associated waves.

Figure 4:
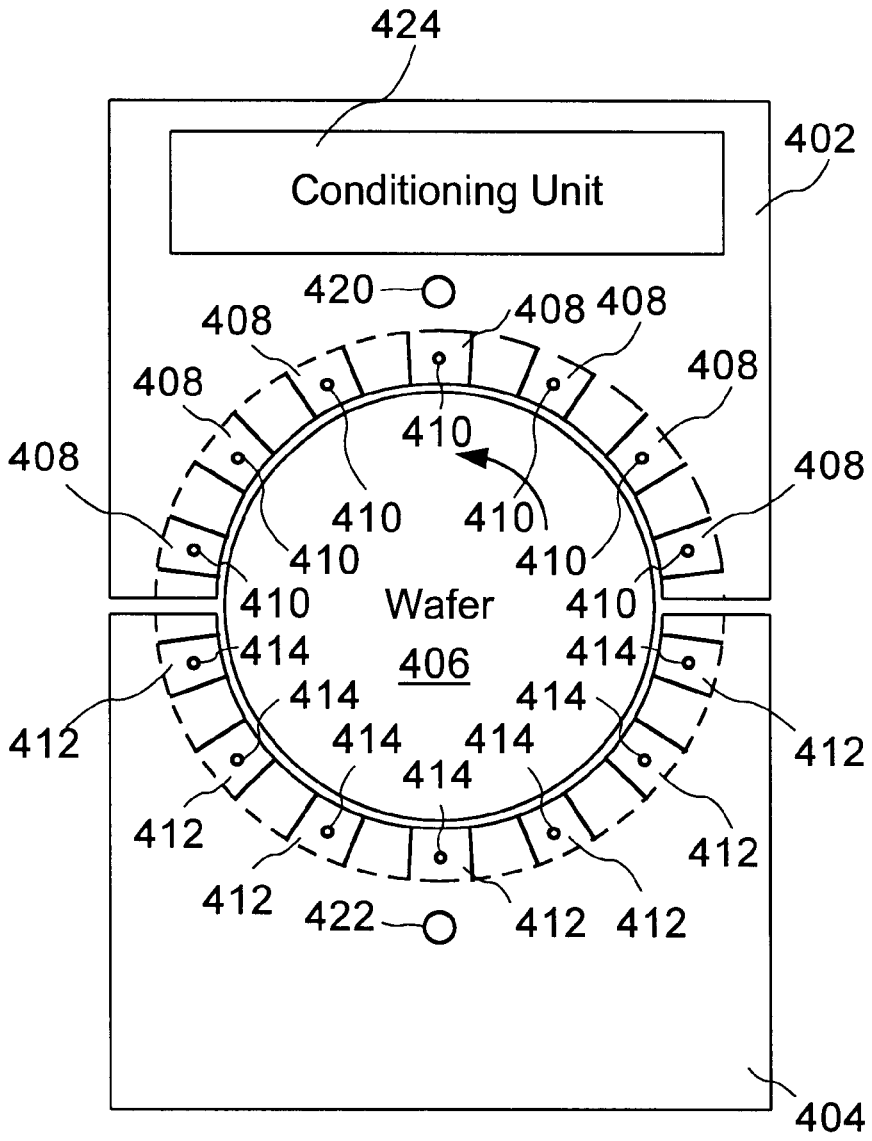
FIG. 4 shows an overview diagram of front and back process units disposed around a wafer in accordance with one embodiment of the present invention.

In addition to masking the edge of the wafer and suppressing the waves, the front and back process units of the present invention may be configured to provide additional functions. By way of example, FIG. 4 shows an overview diagram of front and back process units 402 and 404 disposed around a wafer 406 in accordance with one embodiment of the present invention. The front process unit 402 includes a conditioning unit 424 for conditioning or reviving the surface of a polishing pad. For example, the conditioning unit 424 may be implemented by using any suitable devices for conditioning a polishing pad such as a conditioning unit 320 shown in FIG. 3A.

In the front process unit 402, a plurality of slots 408 (e.g., chambers, cavities, etc.) is formed along the inner region adjacent to the wafer 406. Each of the slots 408 is arranged to receive slurry through a channel 410 (e.g., tube, aperture, opening, passage, etc.) formed above each of the slots 408. The channels 410 are coupled to a slurry dispenser to provide slurry to the slots 408 during CMP processing. Thus, the front process unit 402 supplies the slurry directly under the edge of the wafer through the slots 408. The channels 410 and slots 408 for providing slurry directly under the edge of the wafer may also be implemented in the front process unit 310 shown in FIGS. 3A to 3D.

Similarly, the back process unit 404 also includes a plurality of slots 412 formed along the inner region adjacent to the wafer 406. Each of the slots 412 are configured to receive pad cleaning chemistry from a cleaning chemistry dispenser through a channel 414 formed in the back process unit 404. Due to the location of the slots 412 adjacent to the wafer 406, the cleaning chemistry from the slots 412 cleans the surface of the polishing pad immediately after the slurry exits from under the wafer 406. In addition, the back process unit 404 facilitates removal of CMP by-products. The cleaning of the polishing surface immediately after the slurry exits from under the wafer 406 reduces the time and area the polishing surface comes in contact with the slurry and other by-products of CMP processing. Thus, the pad erosion and redeposition of by-products are substantially reduced.

It should be appreciated that the front and back process units 402 and 404 may be configured to provide other functions as well. For example, the back process unit 404 may be used to supply slurry to the wafer in addition to providing the cleaning chemistry through the slots 412. In an alternative embodiment, the back process unit 404 may mirror the function of the front process unit 402. In addition, the CMP system of the present invention may be implemented using only a front processing unit without the back processing unit. In this case, a small active retaining ring may be provided on the periphery of the wafer carrier to retain the wafer in place during CMP processing.

The CMP systems of the present invention provide substantial advantages over conventional CMP systems. For example, in contrast to the CMP systems of the present invention, conventional CMP systems typically provide slurry at some distance away from the wafer. Due to the distance, these systems often exhibit slurry starvation effect at the center of a wafer. The front process unit of the present invention overcomes the slurry starvation effect of conventional CMP systems by providing slurry directly under the wafer edge via slots 408, which are adjacent to the wafer 406. These slots 408 also allow enhanced in situ slurry mixing in cases where the components are delivered separately. As a result, the front process unit 402 substantially improves uniform slurry distribution under the wafer 406 and increases total removal rate. Further, this arrangement reduces the slurry consumption due to the enhanced slurry distribution.

Figure 5:
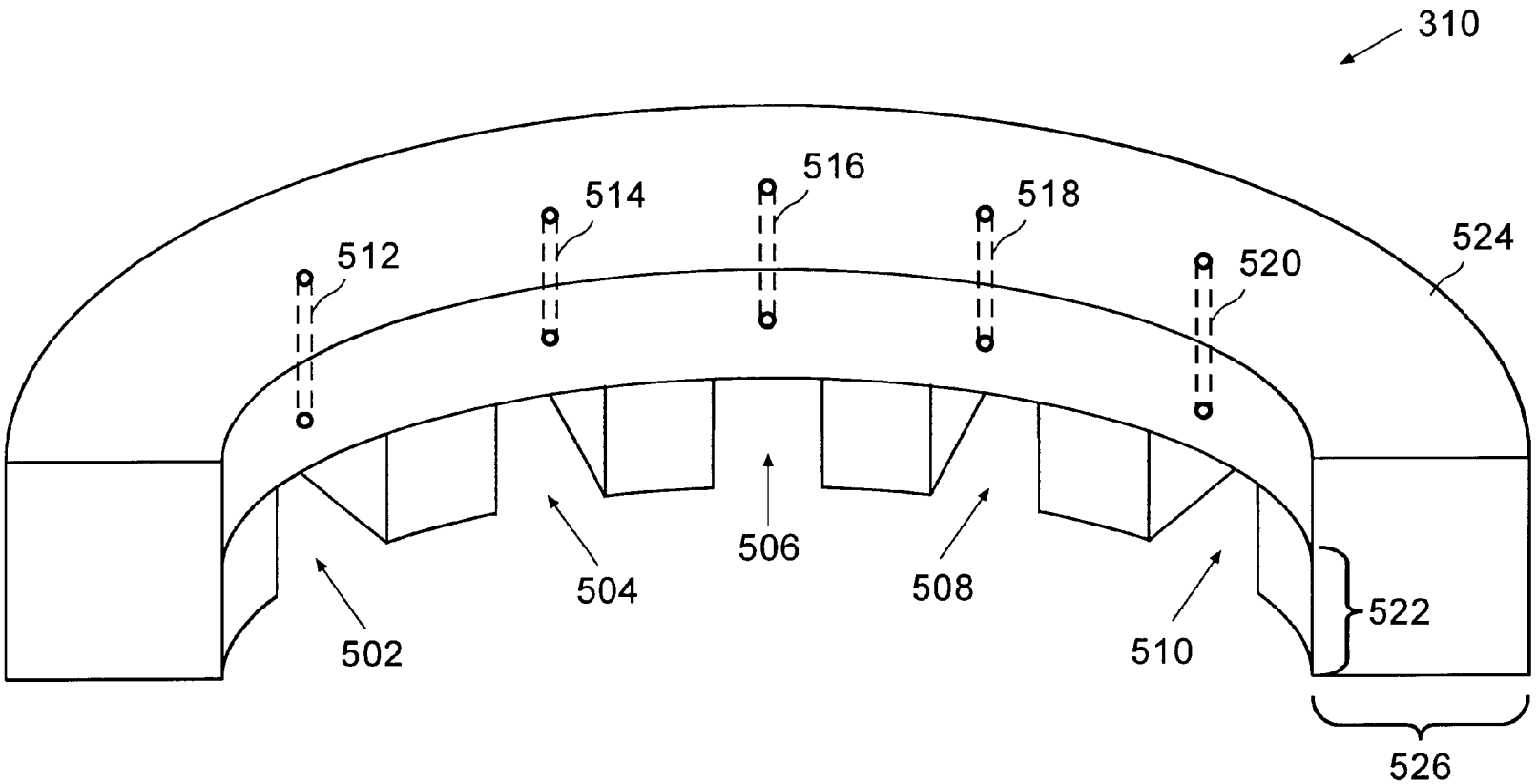
FIG. 5 illustrates a perspective view of a front processing unit in accordance with one embodiment of the present invention.

The slots 408 and 412 and channels 410 and 414 in the front and back processing units may be arranged in any suitable manner to facilitate the supply of slurry and/or cleaning chemistry. For example, FIG. 5 illustrates a perspective view of the front processing unit 310 in accordance with one embodiment of the present invention. In the front processing unit 310, a plurality of channels 512, 514, 516, 518, and 520 are formed to supply slurry to a plurality of slots 502, 504, 506, 508, and 510, respectively. The slots 502 to 510 are formed on a lower portion 522 of the front processing unit 310 to receive and supply the slurry under a wafer. Preferably, the slots 502 to 510 are formed to be within the lower portion 522 of the front processing unit 310 so that outer edge 524 of the front processing unit 310 is uniform in structure. The slots 502 to 510, for example, may extend about halfway into width 526 of the front processing unit. It should be noted that the slots 502 to 510 and channels 512 to 520 may be arranged in any suitable manner to facilitate supply of slurry under a wafer. For example, the slots 502 to 510 may be formed at a slanted angle to enhance the supply of slurry to rotating wafer. The slots 502 to 510 and channels 512 to 520 may also be provided in a similar configuration in the back process units of the present invention to facilitate the supply of cleaning chemistry and/or slurry.

Figure 6A:
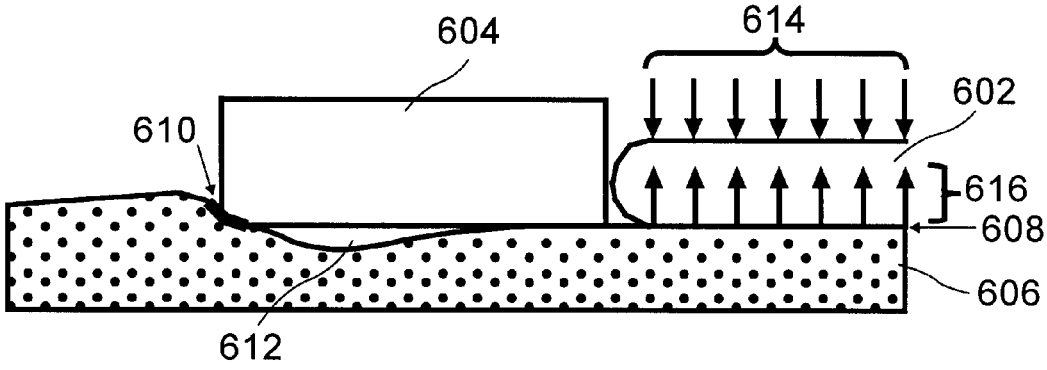
FIG. 6A shows a cross-sectional view of a section of a wafer and a front process unit that are arranged to mask the edge effect of a wafer in accordance with one embodiment of the present invention.

FIG. 6A shows a cross-sectional view of a section of a wafer 602 and a front process unit 604 that are arranged to mask the edge effect of the wafer 602 in accordance with one embodiment of the present invention. The wafer 602 and the front process unit 604 are placed on a polishing pad 606. In this arrangement, the front process unit 604 and the wafer 308 are decoupled so that both are aligned to the plane of the polishing surface 608 on the polishing pad 606. The presence of the front process unit 604 moves the high pressure edge point away from the wafer 606 to an outside edge 610 (i.e., leading edge) of the front process unit 604. Similarly, the independent front process unit 604 moves the low pressure zone 612 away from the wafer 602 to a location near the outside edge 610 of the front process unit 604. Thus, when a downforce indicated by vectors 614 is applied, the normal pressure vectors 616 under the wafer 308 are substantially uniform in magnitude and direction. In this manner, the front process unit 604 effectively masks the edge of the wafer 602 from undesirable edge effects by transferring the edge effect from the edge of the wafer 602 to the outside edge 610 of the front process unit 604. Eliminating the edge effect under the wafer 602, in turn, allows slurry to be provided more evenly under the wafer 602. Accordingly, the planarization efficiency of the wafer 602 is substantially enhanced. Likewise, the back process unit of the present invention reduces the edge effect under the wafer 602 in a similar manner.

Figure 6B:
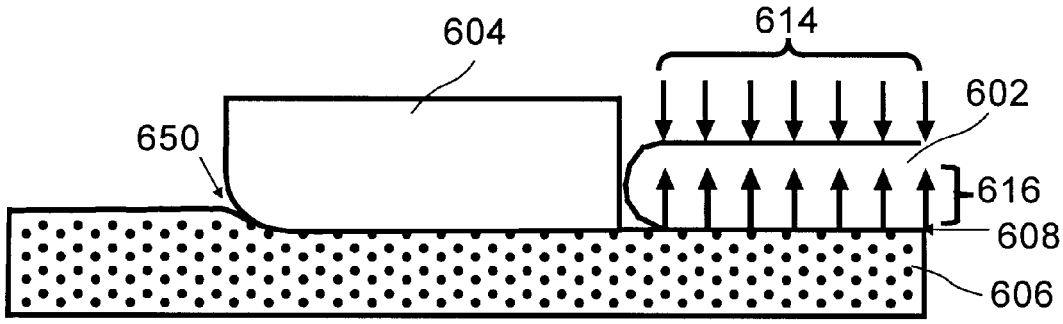
FIG. 6B shows a cross-sectional view of a section of the wafer and the front process unit that are arranged to reduce the edge effect and suppress pressure waves in accordance with another embodiment of the present invention.

The outer edge of the front or back process units of the present invention can also be configured to further improve the planarization efficiency. FIG. 6B shows a cross-sectional view of a section of the wafer 602 and the front process unit 604 that are arranged to reduce the edge effect and suppress pressure waves in accordance with one embodiment of the present invention. The wafer 602 and the front process unit 604 are placed on the polishing pad 606 and operate to independently align to the plane of the polishing surface 608 on the polishing pad 606. The outer edge 650 of the front process unit 604 is shaped to minimize pressure. In the illustrated embodiment, the outer edge 650 is rounded to reduce the pressure so that the formation low pressure wave zones under the front process unit 604 is minimized, thereby further enhancing uniform planarization of the wafer 508.

While the present invention has been described in terms of several preferred embodiments, it will be appreciated that those skilled in the art upon reading the preceding specifications and studying the drawings will realize various alterations, additions, permutations and equivalents thereof. It is therefore intended that the present invention includes all such alterations, additions, permutations, and equivalents as fall within the true spirit and scope of the invention.

What is claimed is:

1. An edge instability suppressing device for use in planarizing a surface topography on a wafer in a chemical mechanical planarization (CMP) system, the CMP system including a wafer carrier for holding and rotating a wafer on a polishing surface of a polishing pad, the polishing pad being arranged to move in a first direction, the device comprising:

a front process unit disposed around a first portion of the wafer facing the first direction and arranged to align to the polishing surface of the polishing pad independent of the wafer during CMP processing; and a back process unit disposed around a second portion of the wafer opposite the first portion, the back process unit being arranged to align to the polishing surface of the polishing pad independent of the wafer during the CMP processing, wherein the aligned front and back process units substantially reduce edge effects on the wafer during the CMP processing, wherein the front process unit includes, a plurality of first channels formed in the front process unit for receiving slurry; and a plurality of first slots formed on a bottom portion of the front process unit adjacent to the wafer and being arranged to receive the slurry through the first channels, wherein the slurry from the first slots is provided under the wafer for planarizing the surface topography of the wafer.

2. The edge instability suppressing device as recited in claim 1, wherein the front process unit includes a first controller configured to determine a pressure to be applied on the front process unit and a position of the front process unit and wherein the back process unit includes a second controller configured to determine a pressure to be applied on the back process unit and a position of the back process unit.

3. The edge instability suppressing device as recited in claim 2, wherein the first process unit further includes a first arm arranged to apply the pressure and position from the first controller on the front process unit and wherein the back process unit further includes a second arm arranged to apply the pressure and position from the second controller on the back process unit.

4. The edge instability suppressing device as recited in claim 2, wherein the first process unit further includes a conditioning unit for conditioning the polishing surface of the polishing pad.

5. The edge instability suppressing device as recited in claim 2, wherein the back process unit includes:

a plurality of second channels formed in the back process unit for receiving a cleaning chemistry; and a plurality of second slots formed on a bottom portion of the back process unit adjacent to the wafer and being arranged to receive the cleaning chemistry through the second channels for cleaning the polishing surface of the polishing pad.

6. The edge instability suppressing device as recited in claim 1, wherein the front process unit is arranged in a semi-circular ring shape around the first portion of the wafer and wherein the back process unit is arranged in a semi-circular ring shape around the second portion of the wafer.

7. The edge instability suppressing device as recited in claim 1, wherein the first direction of the polishing pad is linear.

8. The edge instability suppressing device as recited in claim 1, wherein the first direction of the polishing pad is circular.

9. The edge instability suppressing device as recited in claim 1, wherein each of the front and back process units include a bottom surface and wherein the bottom surfaces of the front and back process units align to the polishing surface of the polishing pad during the CMP processing.

10. The edge instability suppressing device as recited in claim 1, wherein the front and back process units are arranged to retain the wafer during the CMP processing.

11. The edge instability suppressing device as recited in claim 1, wherein outer edges of the front and back process units in contact with the polishing surface are rounded.

12. A chemical mechanical planarizing (CMP) system for planarizing a surface topography on a wafer, comprising:

a polishing pad having a polishing surface for planarizing the surface topography of a wafer and being arranged to move in a specified direction;

a wafer carrier for holding and rotating the wafer on the polishing surface of the polishing pad;

a first process unit disposed around a first portion of the wafer facing the first direction and arranged to align to the polishing surface of the polishing pad independent of the wafer during CMP processing wherein the fit process unit directly delivers slurry to the polishing pad by way of a first dispenser; and a second process unit disposed around a second portion of the wafer opposite the first portion, the second process unit being arranged to align to the polishing surface of the polishing pad independent of the wafer during the CMP processing, wherein the aligned first and second process units substantially reduce edge effects on the wafer during the CMP processing, and wherein the second process unit is separate from the first process unit and directly delivers cleaning chemistry to the polishing pad by way of a second dispenser, the second dispenser being separate from the first dispenser.

13. The CMP system as recited in claim 12, wherein the first process unit includes:

a plurality of first channels arranged to receive slurry; and a plurality of first slots formed on a bottom portion of the first process unit adjacent to the wafer and being arranged to receive the slurry through the first channels, wherein the slurry from the first slots is provided under the wafer for planarizing the surface topography of the wafer.

14. The CMP system as recited in claim 12, wherein the first process unit includes a first controller configured to apply a pressure and position on the first process unit and wherein the second process unit includes a second controller configured to apply a pressure and position on the second process unit such that the first and second process units align to the polishing surface of the polishing pad.

15. The CMP system as recited in claim 14, wherein the first process unit further includes a first arm arranged to apply the pressure and position from the first controller on the front process unit and wherein the second process unit further includes a second arm arranged to apply the pressure and position from the second controller on the back process unit.

16. The CMP system as recited in claim 12, wherein the first process unit further includes a conditioning unit for conditioning the polishing surface of the polishing pad.

17. The CMP system as recited in claim 12, wherein the second process unit includes:

a plurality of second channels formed in the second process unit for receiving a cleaning chemistry; and a plurality of second slots formed on a bottom portion of the second process unit adjacent to the wafer and being arranged to receive the cleaning chemistry through the second channels for cleaning the polishing surface of the polishing pad.

18. The CMP system as recited in claim 12, wherein the first process unit is arranged in a semi-circular ring shape around the first portion of the wafer and wherein the second process unit is arranged in a semi-circular ring shape around the second portion of the wafer.

19. The CMP system as recited in claim 12, wherein the first and second process units are configured to retain the wafer during the CMP process.

20. The CMP system as recited in claim 12, wherein outer edges of the first and second process units in contact with the polishing surface are rounded.

21. A chemical mechanical planarizing (CMP) system for planarizing a surface topography on a wafer, comprising:

a polishing pad having a polishing surface for planarizing the surface topography of a wafer and being arranged to move in a specified direction;

a wafer carrier for holding and rotating the wafer on the polishing surface of the polishing pad; and a first process unit disposed around a first portion of the wafer facing the first direction and arranged to align to the polishing surface of the polishing pad independent of the wafer during CMP processing, the first process including;

a plurality of first channels arranged to receive slurry; and a plurality of first slots formed on a bottom portion of the first process unit adjacent to the wafer and being arranged to receive the slurry through the first channels, wherein the slurry from the first slots is provided under the wafer for planarizing the surface topography of the wafer.

22. The CMP system as recited in claim 21, further comprising:

a second process unit disposed around a second portion of the wafer opposite the first portion, the second process unit being arranged to align to the polishing surface of the polishing pad independent of the wafer during the CMP processing, wherein the aligned first and second process units substantially reduce edge effects on the wafer during the CMP processing.

23. The CMP system as recited in claim 22, wherein the first process unit includes a first controller configured to apply a pressure and position on the first process unit and wherein a second process unit includes a second controller configured to apply a pressure and position on the second process unit such that the first and second process units align to the polishing surface of the polishing pad.

24. The CMP system as recited in claim 23, wherein the first process unit further includes a first arm arranged to apply the pressure and position from the first controller on the front process unit and wherein the second process unit further includes a second arm arranged to apply the pressure and position from the second controller on the back process unit.

25. The CMP system as recited in claim 21, wherein the first process unit further includes a conditioning unit for conditioning the polishing surface of the polishing pad.

26. The CMP system as recited in claim 22, wherein the second process unit includes:

a plurality of second channels formed in the second process unit for receiving a cleaning chemistry; and a plurality of second slots formed on a bottom portion of the second process unit adjacent to the wafer and being arranged to receive the cleaning chemistry through the second channels for cleaning the polishing surface of the polishing pad.

27. The CMP system as recited in claim 22, wherein the first process unit is arranged in a semi-circular ring shape around the first portion of the wafer and wherein the second process unit is arranged in a semi-circular ring shape around the second portion of the wafer.

28. The CMP system as recited in claim 21, wherein an outer edge of the first process unit in contact with the polishing surface is rounded.

* * * * *